US005487824A

United States Patent [19]

Griego

[11] Patent Number: 5,487,824

[45] Date of Patent: Jan. 30, 1996

[54] ELECTROPLATING APPARATUS AND ELECTROPLATING METHOD OF SMALL ARTICLES

[75] Inventor: Thomas P. Griego, Grants, N.M.

[73] Assignee: Uemura Kogyo Kabushiki Kaisha, Osaka, Japan

[21] Appl. No.: 295,055

[22] Filed: Aug. 26, 1994

[30] Foreign Application Priority Data

Aug. 31, 1993 [JP] Japan ..... 5-215636
Apr. 4, 1994 [JP] Japan ..... 6-065999

[51] Int. Cl.[6] ..... C25D 7/00; C25D 17/16; C25D 21/12

[52] U.S. Cl. ..... 205/128; 205/143; 205/145; 204/201; 204/212

[58] Field of Search ..... 204/212, 201, 204/275; 205/128, 143, 145

[56] References Cited

U.S. PATENT DOCUMENTS 1,910,145 5/1933 Belke ..... 205/145 X
2,721,837 10/1955 Backer ..... 205/143
3,359,195 12/1967 Hojyo ..... 204/201 X
3,425,926 2/1969 Hojyo ..... 204/201 X
4,182,669 1/1980 Hojyo ..... 204/201 X

*Primary Examiner*—Donald R. Valentine
*Attorney, Agent, or Firm*—Evenson, McKeown, Edwards & Lenahan

[57] ABSTRACT

An electroplating apparatus of small articles comprising: a horizontal circular bottom disk fixed on a top of a vertical drive shaft concentrically, a cover having a bottom fixing flange extending outwardly, upper opening and forming between the bottom disk a treatment room the height of the room changing gradually low as the radius increases or simply cylindrical, a minus contact ring or intermittent minus contact ring disposed between the bottom disk and flange, porous ring being disposed near the contact ring allowing only to pass an electroplating liquid in the cover by centrifugal force, supply pipes supplying electroplating liquid etc. from the opening, a cellar receiving electroplating liquid etc. scattered from the porous ring, a pump feeding the liquid gathered in the cellar to the supply pipe, an anode inserted from the opening and contacting electroplating liquid, and during the electroplating, the bottom disk and cover repeat rotation and stopping or rotation and decelerating.

5 Claims, 4 Drawing Sheets

ELECTROPLATING APPARATUS AND ELECTROPLATING METHOD OF SMALL ARTICLES

TECHNICAL FIELD

Present invention relates to electroplating apparatus and electroplating method of small articles (small size parts) such as powder (5~100 μm), chip condenser, diode, connecter, leadswitch, peg, bolt, nut, washer etc.

BACKGROUND OF THE INVENTION

In a prior apparatus, on a revolution rotary horizontal disk fixed at the upper end of a vertical drive shaft, two containers are settled at the opposite ends of a circle and rotate reverse side against the disk, small articles (to be electroplated) in the containers and electroplating liquid are urged to the inner surface of the containers at the outside position of revolution and rotate and revolute for electroplating (named as ROTARY-CHROMER). But in the above containers, as the amount of the electroplating liquid is limited relatively small amount, the density of the liquid changed to lean as time passes, it is impossible to get sufficient electroplating thickness, and it is impossible to conduct many processes including electroplating continuously in one above apparatus.

An automatic chrome electroplating apparatus as shown in FIG. 4 is disclosed (U.S. Pat. No. 3,359,195). In FIG. 4, 111 is a rotary body, 112 is a discharge passage, 113 is a cone shaped surface, 114 is a cathode net, 115, 115' are anode plates, 116 is a anode wire, 117 is operating rod, 118 is a valve, 119 is a support frame, 120 is a pulley, 121 is inlet port, 122 is a connecting member, 123 are insulators, 124 is a vis as a sample to be electroplated, 126 is a lead, 127 is a connecting slider. While the valve 118 is closed and electroplating liquid and a lot of vises 124 are put inside, rotary body 111 is rotated intermittently three or four times, during the rotation vises 124 slide up the cone shaped surface 113 and contact the cathode net 114 in various posture so as to form uniform and good chrome electroplating layer. But the quantity of electroplating liquid in the vessel is limited (There is no circulation tank, and quantity of the liquid is small), the density of the liquid changes to weak as time passes, sufficient layer thickness is not obtainable in that electroplating by high electric current density is not kept long. Besides, once the valve 118 is lifted up, liquid in the vessel as well as vises 124 are evacuated through discharge passage 112, various continuous processes including electroplating are not effected in this one apparatus.

In the prior barrel system, hexagonal cylinder barrel made of porous plate is slowly rotated (for example 20 r.p.m.) with its cylinder center being horizontal in the electroplating liquid in the shell (case), in the barrel a cathode cable is inserted the cable being provided with cathode electrode (dangler) on the tip end to make good contact with small articles to be electroplated, and outside of the barrel anode electrode is installed. In this system, a lot of dummy (for example iron ball with 2 mm diameter) must be put into the barrel to increase the chance of contact between small articles (work) and dangler (cathode electrode), but it is difficult to get an uniform and sufficient electric current density. Since the liquid is still, the density of the liquid changes to weak as time passes, sufficient layer thickness is not obtainable and various continuous processes including electroplating are not effected in this one apparatus.

Chip condenser 100 shown in FIG. 5 is a hexahedron made of ceramic (for example, nitring alumina) and its measurements are for example $L_2=L_3=0.5$ mm, $L_1=1$ mm, and opposed ends 102 (mesh part) are fixed by Ta. When this material and dummy are put into the prior barrel and Ni—Sn or Ni-Solder electroplating is applied to form the layer of 1~2 μm, electric current density is low 0.2 A/dm$^2$ and required 60 minutes. As explained above, according to the prior systems, efficiency is 100 and thickness of layer is ununiform.

OBJECT OF THE INVENTION

1st invention aims to get a sufficient and uniform electroplating layer in short time. 2nd invention aims to avoid mixing of circulating treatment liquid and facilitate liquid control. 3rd invention aims to facilitate unload the works and to facilitate the division of the processes. 4th invention aims to conduct continuously from electroplating to dehydrating in one apparatus. 5th invention aims to prevent oxidation of work prior to electroplating.

SUMMARY OF THE INVENTION

In accordance with the present 1st invention, an electroplating apparatus of small articles comprising: a horizontal circular bottom disk fixed on a top of a vertical drive shaft concentrically, a cover having a bottom fixing flange extending outwardly, upper opening and forming between the bottom disk a treatment room the height of the room changing gradually low as the radius increases or simply cylindrical, a minus contact ring or intermittent minus contact ring disposed between the bottom disk and flange, porous ring being disposed near the contact ring allowing only to pass an electroplating liquid in the cover by centrifugal force, supply pipes supplying electroplating liquid etc. from the opening, a cellar receiving electroplating liquid etc. scattered from the porous ring, a pump feeding the liquid gathered in the cellar to the supply pipe, an anode inserted from the opening and contacting electroplating liquid, and during the electroplating, the bottom disk and cover repeat rotation and stopping or rotation and decelerating.

2nd invention; an electroplating apparatus of small articles of 1st invention wherein the cellar receiving electroplating liquid etc. provide an outside wall where scattering electroplating liquid collides, an annular bottom wall, inside wall standing up from the inner periphery of the bottom wall up to the near of the bottom wall, a tubular separate wall standing up from the bottom wall and middle part between outside wall and inside wall to a little lower part of the top surface of the bottom disk, one or plural operation liquid outlets on the bottom wall of both side of the tubular separate wall, a cover plate extending inwardly from the top of the outside wall and its opening for operation is a little large than bottom disk, and inside of the tubular separate wall there is a separate pipe with a larger diameter than bottom disk and on top of the separate pipe an upper wall is fixed the inside diameter of the upper wall is a little larger than the bottom disk, an up and down mechanism is provided to locate the upper wall in the lowest position in which the upper surface of the upper wall is kept lower than the porous ring and the upper position in which the separate pipe faces the porous ring.

3rd invention; an electroplating apparatus of small articles of 1st invention wherein the circular bottom disk is provided with a main disk fixed on top of a drive shaft concentrically, an upper disk disposed on the main disk concentrically, a coupling mechanism disposed the main disk and the upper disk so as to transmit normal and reverse rotation, a transfer mechanism to lift up the upper disk and fixed cover when supply pipes, an anode, a minus holder a lower brush of which contacts the contact ring etc. are removed outwardly.

4th invention; an electroplating method of small articles utilizing an apparatus comprising an treatment room fixed the upper end of a drive shaft concentrically the room being tubular with vertical center or the height of the room changing gradually low as radius increases, a minus contact ring to supply electricity being disposed the maximum diameter inside part or lower inside end of the treatment room, a porous ring near the contact ring allowing only operation liquid to pass not allowing small articles to be electroplated to pass, an anode being disposed through an upper opening of the treatment room, characterizing in that, small articles to be treated is loaded in the treatment room, then an electroplating liquid is poured until the anode is always dipped, then above treatment room is rotated in a certain time and stopped in a short time or decelerate in a short time and above cycle is repeated, then after a certain time supply of electroplating liquid is stopped, then rinse water is supplied, then after another certain time supply of rinse water is stopped, then the water is centrifugally dehydrated by high rotation.

5th invention; an electroplating method of small articles utilizing an apparatus comprising an treatment room fixed the upper end of a drive shaft concentrically the room being tubular with vertical center or the height of the room changing gradually low as radius increases, a minus contact ring to supply electricity being disposed the maximum diameter inside part or lower inside end of the treatment room, a porous ring near the contact ring allowing only operation liquid to pass not allowing small articles to be electroplated to pass, an anode being disposed through an upper opening of the treatment room, characterizing in that, small articles to be treated is loaded in the treatment room, then while the treatment room is rotated, a former treatment liquid is poured through the opening and former treatment is conducted for a predetermined time, then supply of the former treatment liquid is stopped and prior to the small articles are exposed to the air, rinse water is supplied for water rinse for another predetermined time, then supply of rinse water is stopped and prior to the small articles are exposed to the air, electroplating liquid is supplied.

DESCRIPTION OF THE PREFERRED EMBODIMENTS

Figure 1:
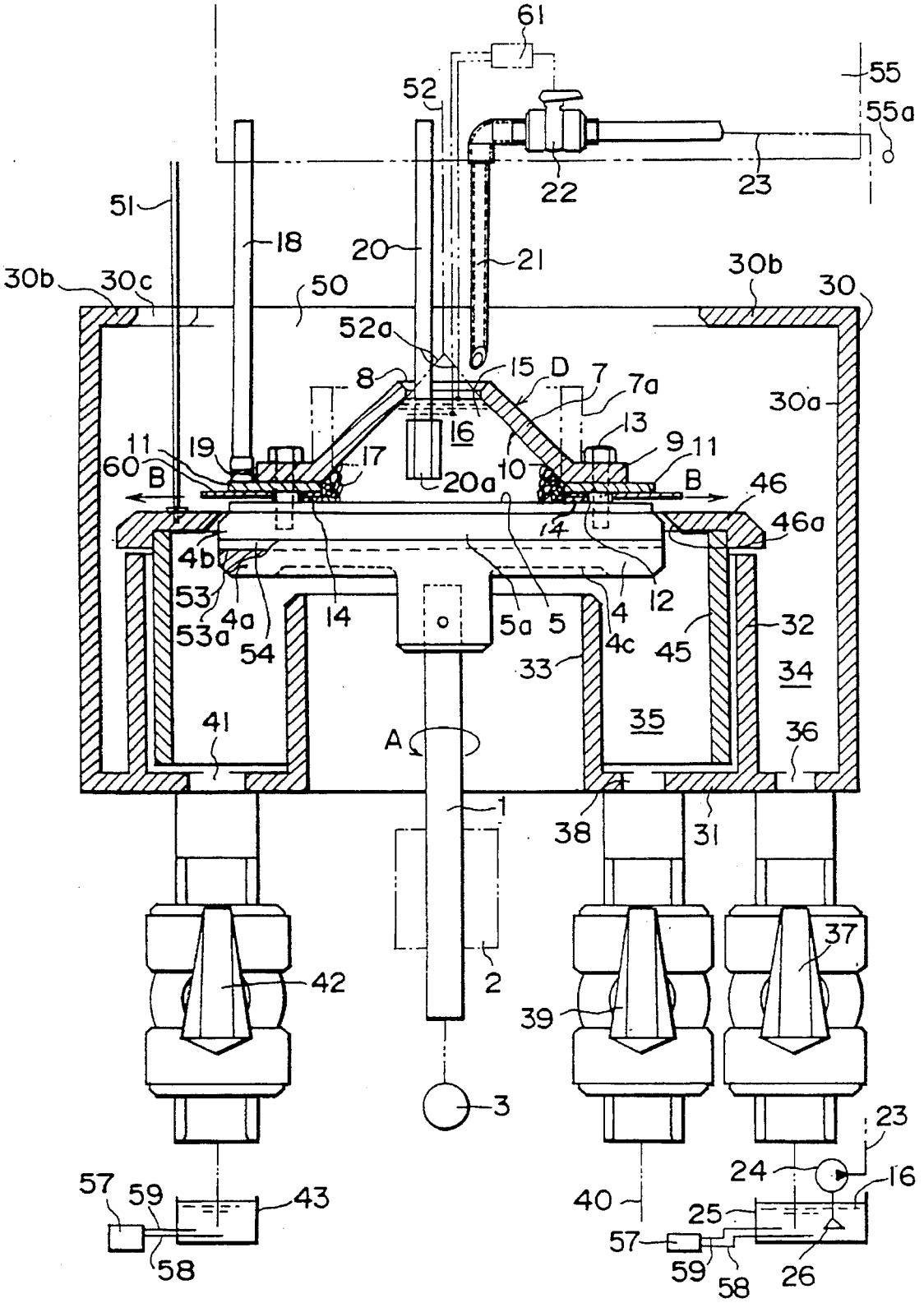
FIG. 1 is a sectional brief view illustrative of an electroplating process.

In FIG. 1 showing electroplating process, a vertical drive shaft 1 is rotatably mounted on a frame (not shown) via bearing 2, lower end of which is connected to a motor 3 (rotatable in normal or reverse direction, speed changeable, possible to stop suddenly) and on the upper end a circular bottom disk 4 is fixed. The bottom disk 4 is of horizontal circular and provided with main disk 4*a* made of SUS fixed on the upper end of drive shaft 1 concentrically and an upper disk 4*b* made of PVC with upper flat surface 5. Main disk 4*a* and upper disk 4*b* are engaged concentrically via a joint 54 which is consisted of radial grooves 53 with rectangular cross section formed on the upper surface of main disk 4*a* and radial projection 53*a* formed under surface of upper disk 4*b* and grooves 53 engage projection 53*a* so as to transmit the rotation. Main disk 4*a* is provided with an annular groove 4*c* which outer diameter is larger than inside wall 33 hereinafter explained then the groove 4*c* acts as a drainer.

Circular plastic cover 7 has central uppermost opening 8, extending outwardly lower most flange 9 for attachment and downwardly opening taper inside surface 10 between the opening 8 and the flange 9. Below the flange, there is an annular contact ring 11 made of titanium the inner diameter of which being same as that of the inner diameter of flange 9 and outer diameter of which being a little larger than that of the outer diameter of flange and on the outwardly extending portion of contact ring 11 minus brush is pressed. Below the contact ring 11, there is an annular flexible thin skirt 60 adhered on the outside portion of the contact ring 11 outer diameter of which being a little larger than that of the contact ring 11. Bellow the inside portion of the contact ring 11 there is a porous ring 14 which only permit to pass operation liquid. The flange 9, contact ring 11 and porous ring 14 are fastened to upper disk 4*b* of bottom disk 4 by a lot of bolts via collar 12. Taper 10 makes a treatment room 15 the height of which changing gradually low as radius increases. In rotation, electroplating liquid 16 in the room 15 is pressed outwardly by centrifugal force. Contact ring 11 may be formed by many (same as bolt 13) arc segments which are engaged at stepped portions of both ends as long as electrically conductive and water tightness between flange 9 and porous ring 14 are kept. In this case, each segment is small then yield rate goes up and assures low cost. It is allowable if many spaces on the contact ring 11 cause the brush 19 contact non continuously. Porous ring 14 is made of plastic or ceramic filled with continuous bubbles or porous filter, and permits to pass electroplating liquid or operation liquid but permits not to pass small articles to be electroplated. The diameter of small articles is between 35~50 μm, it is preferable that the diameter of porous ring passage is 20 μm. In place of porous ring 14, a ring with many radius windows filled up by porous material may be used. In this case, collar 12 may be taken out and assure tight coupling of flange 9, contact ring 11, above ring and upper disk. Skirt 60 may be made of Teflon sheet and its inner diameter may be the same with that of contact ring 11 and porous ring 14 and outer periphery extends beyond contact ring 11 and its outer diameter is near the lowest that of inner end surface 46*a*. When upper wall 46 goes up from the position of FIG. 1, outer periphery of skirt 60 bends upwardly, and when upper wall 46 goes down from the position of FIG. 2, outer periphery of skirt 60 bends dowmwardly and returned to the position of FIG. 1.

On the outer and upper surface of contact ring 11, brush 19 fixed the lowest portion of minus holder 18 presses slidably. The holder 18 together with brush 19 may be lifted up through operation opening 50 by way of up and down mechanism (not shown) in the upper operating unit 55 up to a predetermined height as shown in FIG. 2.

Plus electrode 20 has its lowest portion a tubular or plate anode 20*a*, although it is indicated to the left from the center of the treatment room 15 for the convenience to show transfer mechanism 52 hereinafter explained, it is located in the electroplating liquid 16 of the center of treatment room 15 from which the distance is equal to all the small articles 17. In the operating unit 55, an up and down mechanism (not shown) is installed to lift the plus electrode 20 in FIG. 1 up to the predetermined position shown in FIG. 2 through operation opening 50. 21 is a vertical supply pipe for electroplating liquid the lowest port of which opens at upper portion of opening 8 and upper part of supply pipe 21 is connected to an outlet port of a pump 24 through a hose 23 including cock 22. Inlet port of the pump 24 connects to a filter 26 located inside the tank 25 of electroplating liquid. An up and down mechanism (not shown) for lift up the supply pipe 21 through operation opening 50 is installed in the operating unit 55. Above the opening 8, other than supply pipe 21 for electroplating liquid, a supply pipe for removing grease (cleanser), a supply pipe for acid cleanser (hydrochloric acid, sulfuric acid etc.), a supply pipe for rinse water, a supply pipe for hot water, a supply pipe for hot air etc. are installed and they are connected up and down mechanisms (not shown) separately same as supply pipe 21 for electroplating liquid, each supply pipe being connected to a cock and pump corresponding to cock 22 and pump and cocks 39, 42 etc. and their opening, closing, starting, stopping according to processes may be automatically controlled by the operating unit 55. Rinse water supply pipe 49 (FIG. 2) is connected city water via cock, hot water supply pipe is connected to a boiler, and hot air supply pipe is connected to a heater via cock. Operating unit 55 lifts up minus holder 18, plus electrode 20, supply pipe 21 etc. through operation opening 50 then is able to remove these to the side of operation opening 50 (turns around a vertical axis or horizontal axis or removes horizontally). After the removal, combined room of cover 7 and upper disk 4*b* (dome D) is lifted up through operation opening 50 by way of a transfer mechanism 52 which has an open and shut hook 52*a* at the bottom to engage upper part of taper 10, and the dome D is transferred to an unload station (not shown) or is brought down on a main disk corresponding to main disk 4*a* of another apparatus. Instead of cock 22, a multiple channel switch (not shown) may be used and many outlet ports of the multiple channel switch are connected separately to a remove grease liquid (cleanser) supply hose, an acid cleanser (hydrochloric acid, sulfuric acid) supply hose, rinse water supply hose, electroplating liquid supply hose, rinse water supply hose, hot water supply hose and hot air supply hose thus a supply pipe 21 is used for many liquid or air and open and shut control is facilitated. When operating unit is supported around horizontal axis 55*a* (FIG. 1) and rotated clockwise, a part or total up and down mechanisms for holder 18, plus electrode 20, supply pipe 21 may be omitted.

On the frame, a plastic cellar 30 is mounted, and the cellar 30 comprises an outside wall 30*a* which receives directly the electroplating liquid splashed from porous ring 14 by the centrifugal force, a tubular separate wall 32 standing from a middle part of radius of a bottom wall 31 up to the middle height of the circular bottom disk 4 and a tubular inside wall 33 standing from the inner periphery of bottom wall 31 up to close to the outside part of the annular groove 4*c* thus outside electroplating liquid room 34 and inside pretreatment liquid room 35 are separated. An electroplating liquid outlet 36 at the bottom of electroplating liquid room 34 is led to tank 25 via a cock 37. A rinse water outlet 38 at the bottom of pretreatment liquid room 35 is led to a drain pipe 40 via cock 39. A pretreatment liquid outlet 41 other than rinse water outlet 38 is led to a tank 43 via cock 42. Another pretreatment liquid outlets (not shown) are led to corresponding tanks via cocks. A filler (not shown) in the tank 43 to supplied to a hidden supply pipe backside of supply pipe 21 for electroplating liquid via a pump, a hose, a cock etc. Tanks 25 and 43 have sufficient volume enough to avoid sudden change of characteristics of electroplating liquid and pretreatment liquid during circulation and the tank 25 is provided at least with a liquid control apparatus 57 to keep ion density of electroplating liquid in a determined value. 58 indicates a probe, and 59 indicates a supply pipe.

Figure 2:
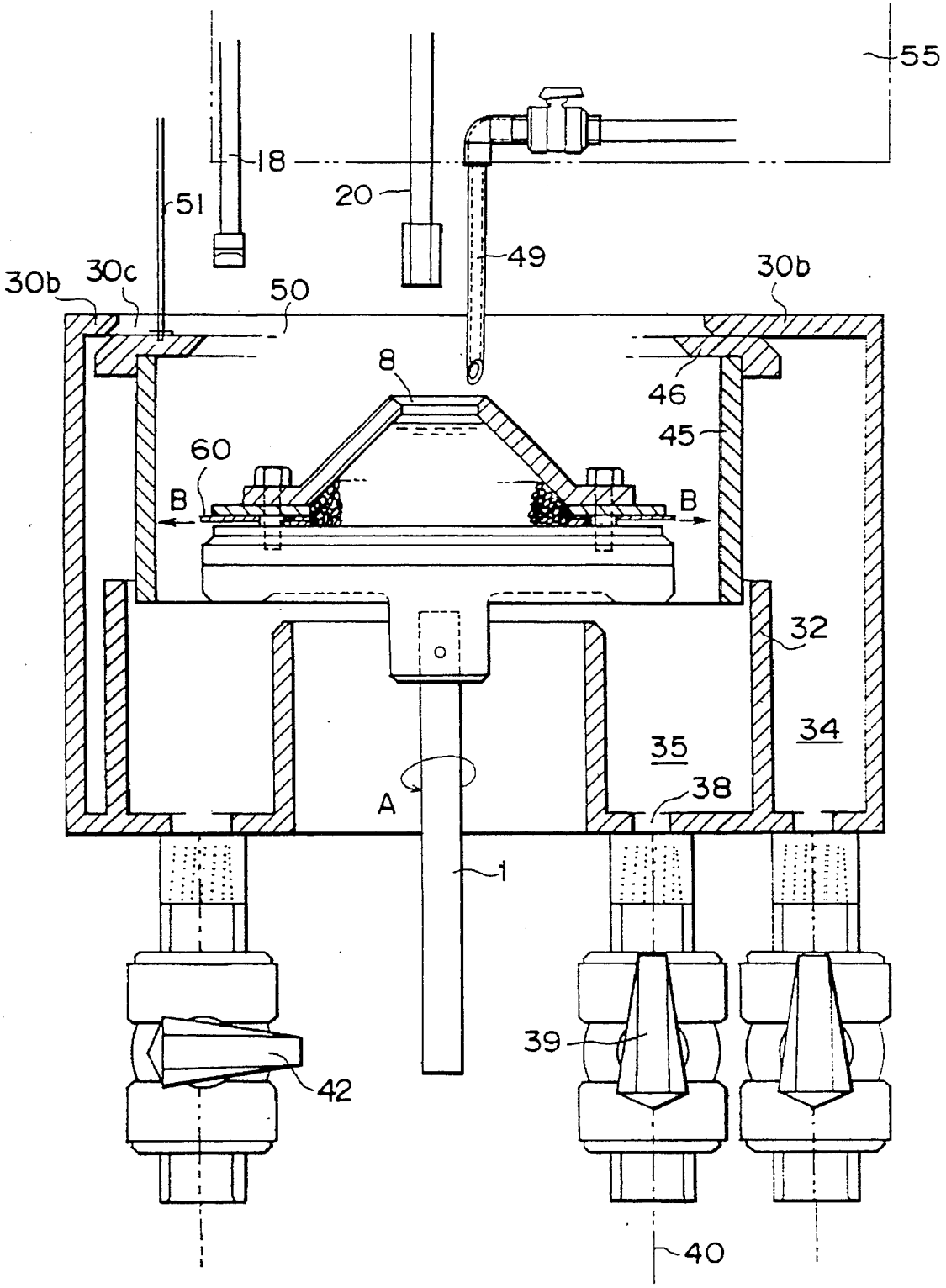
FIG. 2 is a sectional brief view illustrative of a water rinse process.

45 indicates a concentric separate pipe which is of a little small diameter than separate wall and is provided with an annular upper wall 46 on the top of it and transferable from the lowest position as shown in FIG. 1 when upper wall 46 locates a little lower position of the upper surface of bottom disk 4 and uppermost position as shown FIG. 2 by way of up and down mechanism 51. The lowest end of the up and down mechanism 51 is fixed on upper wall 46 through a slit 30*c* and upper end is connected to an air cylinder independent from operating unit 55. As an embodiment, in FIG. 1, inner end surface 46*a* of the upper wall 46 is formed of a downward open taper surface (taper angle: 90° ), and when the upper wall 46 starts to go up from the lowest position (FIG. 1) and passes through upwardly the operation liquid splashed from porous ring 14 as shown an arrow B by centrifugal force, leads the liquid along the taper surface down to the pretreatment liquid room 35 in cooperation with the skirt 60 thus prevents the liquid to splash out of the operation opening 50. In the uppermost position shown in FIG. 2, the lowest part of separate pipe 45 laps for short distance with the upper portion of separate wall 32. At the uppermost position as shown in FIG. 2. upper wall 46 abuts the lower surface of a cover plate 30*b*, thus electroplating liquid room 34 and pretreatment liquid room 35 are separated closely then mixing acid cleaner into electroplating liquid is avoided.

Figure 3:
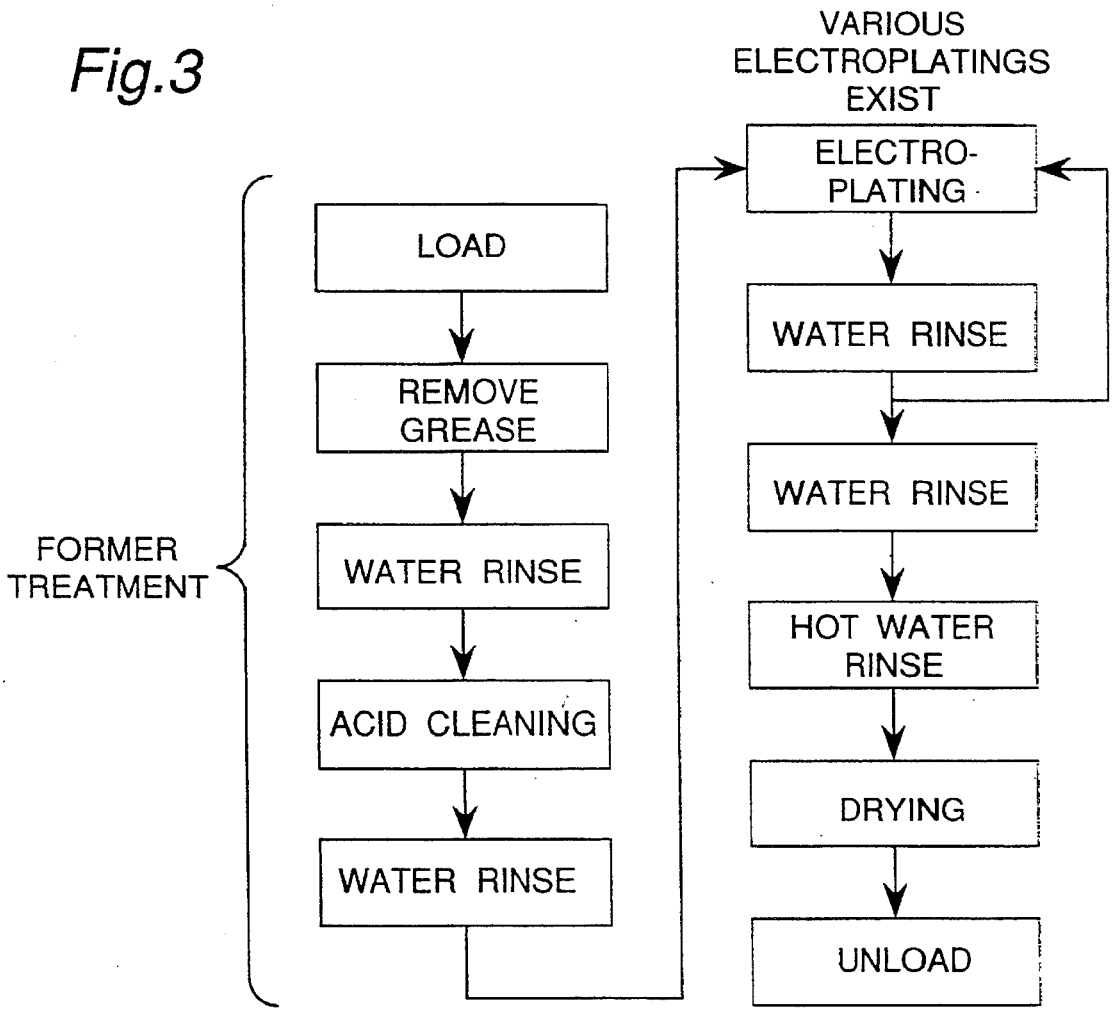
FIG. 3 is a diagrammatical view of processes.

In the load station as shown in FIG. 3, first of all a predetermined amount of small articles 17 is poured in the treatment room 15, after the former treatments are proceeded as hereinafter explained, minus holder 18 is put down then blush 19 contacts with contact ring 11, plus electrode 20 is put down then anode 20*a* is dipped in the electroplating liquid 16, and the supply pipe 21 is put down upper portion of opening 8. Continuously pouring the electroplating liquid 16 from supply pipe 21, a treatment cycle comprising a driver shaft 1 is rounded at 200 r.p.m. in 10 seconds to the direction as arrow A, and is stopped in 0.5 seconds, and is rounded at 200 r.p.m. in 10 seconds to the reverse direction as arrow A, and is stopped in 0.5 seconds, in 5 minuets or a few hours at the longest. During the rotation of the drive shaft 1, the small articles 17 is pressed to the contact ring 11 by a centrifugal force, then on the surfaces of small articles 17 facing the anode 20*a* electroplating layers are formed. When the drive shaft 1 is stopped, the small articles 17 are put down on a flat surface 5 by way of its gravity and liquid flow caused by inertia and at the same time the small articles 17 are mixed. Then the drive shaft 1 starts reverse rotation, small articles 17 are mixingly pressed to the contact ring 11 in the different posture by the centrifugal force as shown in FIG. 1, and on other surfaces of small articles 17 facing anode 20*a* electroplating layer is formed. Electroplating liquid passes through porous ring 14 by centrifugal force, splashes outwardly as arrow B, collides inner surface of outside wall 30*a* of cellar 30 and flows down in electroplating liquid room 34, and returns to the tank 25 from outlet 36 via cock 37. The electroplating liquid in the tank 25 is chemically controlled, is pressed by pump 24 and is supplied to treatment room 15 through hose 23, cock 22 opened, and supply pipe 21, and circulation quantity is controlled so as to the anode always is in contact with electroplating liquid. E1 indicate a level sensor.

When electroplating process ends, pump 24 is stopped, cock 22 is closed, almost all electroplating liquid is scattered out, separate plate 45, plus electrode 20 and minus holder 18 are lifted up as shown in FIG. 2, and rinse water is supplied from a rinse water supply pipe 49. Behavior of small article 17 in water rinse process is preferably the same as that in electroplating process. Rinse water scattered as arrow B collides the separate pipe 45, flows down into the pretreatment liquid room 35, then is drained to drain pipe 40 via open cock 39 during for example 5 minutes.

Once the supply of rinse water is stopped, and after almost all rinse water is scattered, same rinse process is repeated for example 5 minutes, then water is almost taken out by large centrifugal force.

Then hot water at 60°~80° C. is supplied for high rinse efficiency. Hot water is supplied for example for 3 minutes and is stopped. Without supplying hot water, the drive shaft 1 continues turning (including normal turn, stop, reverse turn, stop) for 3 minutes for preliminary drying. Then the rotation increases prior 200 r.p.m. to 600 r.p.m., hot air at 60°~90° C. is supplied for 3 minutes, the drying process terminates and motor 3 is stopped. After the supply pipes for rinse water, hot water, hot air etc. are lifted above operation opening 50 likewise holder 18, plus electrode 20, and these parts are removed aside the operation opening 50 by way of operating unit 55. Dome D (assembly of cover 7 and upper disk **4*b*) containing processed small articles 17 is lifted up through the operation opening 50 by transfer mechanism 52 which is independent to the operation unit 55, is transferred to unload station (not shown) and is turned upside down to take out the small articles. For unloading without lifting up the dome D, a tool made of flexible rod (not shown) with a magnet fix on the lowest end is inserted in the operation room through the opening 8 and turned so as to absorb the small articles 17 by the magnet. A bended flexible tube (not shown) is inserted in the operation room through the opening 8** and turned so as to pull out the small articles by vacuum.

In the former treatment (FIG. 3), removing grease by cleanser, water rinse, acid cleaning by hydrochloric or sulfuric acid and water rinse are generally used, while separate pipe 45 as well as minus holder 18 and plus electrode 20 are lifted uppermost position as shown in FIG. 2. Rotation cycle may be same as that of electroplating process. First of all, cleanser is supplied and kept in the treatment room 15 in for example 5 minutes, then the supply of the cleanser is stopped and prior to the small articles are exposed to the air, rinse water is supplied and kept in for example 5 minutes, then supply of rinse water is stopped and prior to the small articles are exposed to the air, acid cleanser such as hydrochloric acid or sulfuric acid is supplied and kept in for example 5 minutes, then supply of acid cleanser is stopped and prior to the small articles are exposed to the air, rinse water is supplied and kept for example 5 minutes finishing the former treatment, supply of rinse water is stopped and prior to the small articles are exposed to the air, separate pipe 45, holder 18 and electrode are put down in the lowest position (FIG. 1), electroplating liquid is supplied then aforementioned electroplating processes are operated. According to the above former treatment, oxidation in the former treatment and transient period between former treatment and electroplating process is perfectly avoided. If above former treatment is employed, load through unload processes are conducted by an apparatus of FIG. 1 avoiding oxidation and manufacturing high quality articles. But in case a little cleanser or acid like hydrochloric acid is mixed, in the drain pipe 40 a septic tank may be installed. Besides, in the acid like hydrochloric acid and electroplating liquid, a little of rinse water is mixed and is diluted, liquid control may be indispensable. Then, if oxidation in the process is not so sensitive, no liquid period may be set in which liquid is splashed almost perfectly from the small articles between the two process. Removing grease and acid cleaning may be conducted by other apparatuses. In this case, exclusive apparatus for each process may be simplified. In some small articles, total or a part of former treatment may be delated.

When rinse water is supplied, cock 39 in FIG. 2 is kept open and cock 42 is kept close. When former treatment liquid other than rinse water is supplied, cock 42 for cleanser or another cock (not shown) for acid such as hydrochloric acid is kept open, and cock 39 is kept close. Open or close operation of cocks, movement of operating unit 55, and operations of up and down mechanism 51 and transfer mechanism 52 are all controlled automatically. When utilizing the present invention, if the diameter of small article 17 is relatively large, a ring with many radial small opening may be used instead of porous ring 14. For the porous ring 14, a ring made of polypropylene sintered material with many continuous holes of 100 μm is preferable in that the cost is low and have a sufficient strength. As long as the small articles 17 are pressed to the contact ring by the force of gravity and centrifugal force, cover 7 may be cylindrical as shown **7*a* in FIG. 1**.

When applying the 1st invention, various variations may be possible. For example, at least electroplating process, reverse rotation in the cycle of normal rotation—stop—reverse rotation—stop may be changed to normal rotation, and reduction (for example 20~50 r.p.m.) in place of stop is employed thus continuing a cycle of rotation—reduction. Rotation speed in rotation and reduction may be changed continuously or step up or step down, in this case the change of position and posture of small articles 17 occurs frequently thus uniform electroplating layer is obtainable. For example, separate wall 32, separate pipe 45, upper wall 46, up and down mechanism 51 and outlets 36, 38 is removed, bottom wall 31 is inclined left down, outlet 41 is placed at the lowest position, multiple three ways switching valves are arranged vertically or a switching valve with multiple outlets is installed and each outlet of the valve is led to a corresponding tank or drain pipe. According to above construction, construction of cellar 30 is simple, and control of valves becomes easy. As another example, short vertical outlet pipe is connected to the lowest outlet 41, under the outlet pipe several receivers corresponding to the treatment liquids stop one by one during movement in horizontal plane. Each of the receiver is connected to corresponding tank or drain pipe. In this case, switching valve is not necessary. As another example, tanks are installed in a horizontal circle, an apparatus with an outlet at its lowest bottom wall is rotated and stopped when the outlet comes to the corresponding tank by way of intermittent rotation mechanism. In this case, each process is worked by a couple of apparatus and it is efficient for mass production.

MERITS OF THE INVENTION

Figure 5:
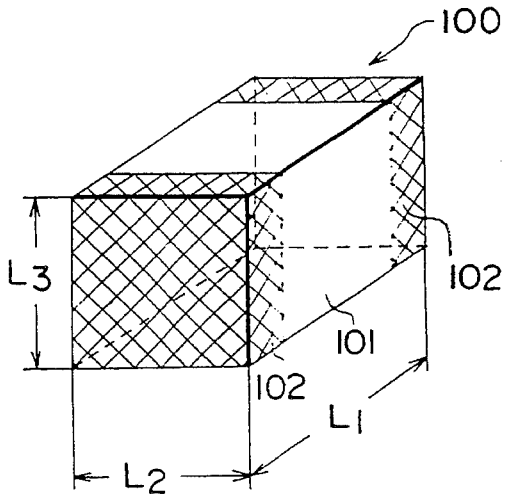
FIG. 5 is an enlarged bird eye view of a small article to be treated.
Figure 4:
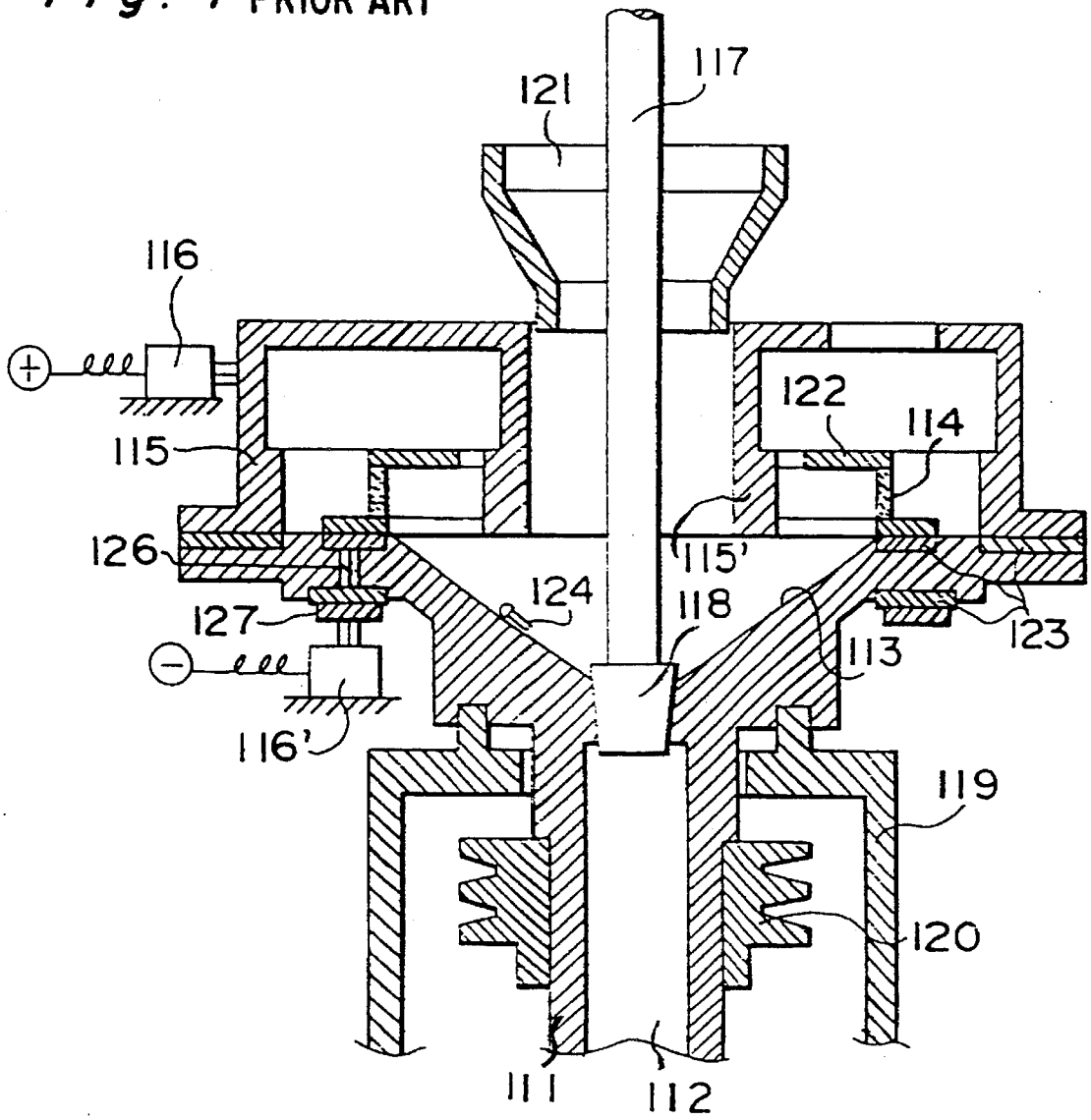
Fig. 4 PRIOR ART
FIG. 4 is a sectional view illustrative of a prior art.

According to the 1st invention, small article is pressed compulsorily to a large area of contact ring 11 by the centrifugal force, and is repeated rotation and stopping or deceleration, since the small article mixes uniformly, conductivity increases, electric current density increases and renewal of electroplating liquid becomes active, electroplating gets well. In FIG. 5, electric current density is 0.2A/dm$^2$ and required 60 minutes to form electroplating Ni layer of 2

μm at the both ends 102, but according to the 1st invention, electric current density increases to 2A/dm$^2$ and operating time are decreased to 10 minutes. Besides, since electroplating liquid 16 in treatment room 15 is changed continuously by fresh electroplating liquid supplied by supply pipe 21, electroplating by high electric current density is possible and it is easy to obtain uniform layer in short time. Since the electroplating liquid is splashed outwardly, control of electroplating liquid outside of the treatment room 15 is easy and high quality layer is obtained. An apparatus is enough to proceed total process without using any dummy. By way of rotation, deceleration, stopping, reverse rotation of electroplating liquid 16, contact between electroplating liquid 16 and anode 20*a* gets well thus increasing electric current density. Since the bottom of treatment room is formed by flat surface 5, liquid is not remain on the surface 5. Since the porous ring 14 is made of electrically non-conductive material such as plastics or ceramics, ratio of opening does not change thus increasing durability, and exchange to conform to the purpose is easy.

According to 2nd invention, since the mixing of treatment liquid is avoided by separate wall 32 and separate pipe 45, control of liquid is easy. Cover plate 30*b* in cooperation with skirt 60 made of Teflon prevents upwardly splash of liquid even when liquid splashes as arrow B and collide on the inner surface of outside wall 30*a*. At the upper most position as shown in FIG. 2, upper wall 46 efficiently prevents upwardly splash of the liquid. Since the combined body of cover 7 and upper disk 4*b* (dome D) can be lifted up through operation opening 50 by transfer mechanism 52 expanding open and shut hock 52*a*, unload of small article 17 is easy. Since it is easy to perform former treatment and electroplating in one place, transfer time for prior barrel move from one cellar to another cellar.

According to 3rd invention, unload of small article 17 (work) is easy and upper disk 4*b* lifted up by transfer mechanism 52 can be installed on a main disk corresponding main disk 4*a* of another apparatus concentrically and non-rotatable each other thus simplifying division of former treatment processes.

According to 4th invention, from electroplating process through centrifugal dehydration drying are performed in one apparatus.

According to 5th invention, oxidation of small article is almost perfectly avoided from beginning of former treatment until electroplating process, and quality of the product is kept high. Of course, multiple layers electroplating may be possible by the process of removing first electroplating liquid, rinsing by water, and supplying second electroplating liquid. For example after coating silver on the base ceramic, Ni electroplating as a first layer and solder electroplating as a 2nd layer may be performed.

What is claimed is:

1. An electroplating apparatus of small articles comprising: a horizontal circular bottom disk fixed on a top of a vertical drive shaft concentrically, a cover having a bottom fixing flange extending outwardly, upper opening and forming between the bottom disk a treatment room the height of the room changing gradually low as the radius increases or simply cylindrical, a cathedic contact ring or intermittent minus contact ring disposed between the bottom disk and flange, porous ring being disposed near the contact ring allowing only to pass an electroplating liquid in the cover by centrifugal force, supply pipes supplying electroplating liquid from the opening, a cellar receiving electroplating liquid scattered from the porous ring, a pump feeding the liquid gathered in the cellar to the supply pipe, an anode inserted from the opening and adapted for contacting electroplating liquid, and during the electroplating, the bottom disk and cover repeat rotation and stopping or rotation and decelerating.

2. An electroplating apparatus of small articles of claim 1, wherein the cellar receiving electroplating liquid provide an outside wall where scattering electroplating liquid collides, an annular bottom wall, inside wall standing up from the inner periphery of the bottom wall up to the near of the bottom wall, a tubular separate wall standing up from the bottom wall and middle part between outside wall and inside wall to a little lower part of the top surface of the bottom disk, one or plural operation liquid outlets on the bottom wall of both side of the tubular separate wall, a cover plate extending inwardly from the top of the outside wall and its opening for operation is a little large than bottom disk, and inside of the tubular separate wall there is a separate pipe with a larger diameter than bottom disk and on top of the separate pipe an upper wall is fixed the inside diameter of the upper wall is a little larger than the bottom disk, an up and down mechanism is provided to locate the upper wall in the lowest position in which the upper surface of the upper wall is kept lower than the porous ring and the upper position in which the separate pipe faces the porous ring.

3. An electroplating apparatus of small articles of claim 1, wherein the circular bottom disk is provided with a main disk fixed on top of a drive shaft concentrically, an upper disk disposed on the main disk concentrically, a coupling mechanism disposed the main disk and the upper disk so as to transmit normal and reverse rotation, a transfer mechanism to lift up the upper disk and fixed cover when supply pipes, an anode, a cathodic holder a lower brush of which contacts the contact ring are removed outwardly.

4. An electroplating method of small articles utilizing an apparatus comprising a treatment room fixed to the upper end of a drive shaft concentrically, the room being tubular with vertical center or the height of the room changing gradually low as radius increases, a cathodic contact ring to supply electricity being disposed the maximum diameter inside part or lower inside end of the treatment room, a porous ring near the contact ring allowing only operation liquid to pass and not allowing small articles to be electroplated to pass, an anode being disposed through an upper opening of the treatment room, the method comprising the steps of:

loading small articles to be treated in the treatment room;

pouring an electroplating liquid until the anode is always dipped;

rotating the above treatment room in a certain time and stopped in a short time or decelerate in a short time and repeating the above cycle;

after a certain time, stopping the supply of electroplating liquid;

supplying rinse water;

after another certain time, stopping the supply of rinse water; and dehydrating the water centrifugally by high rotation.

5. An electroplating method of small articles utilizing an apparatus comprising a treatment room fixed to the upper end of a drive shaft concentrically, the room being tubular with vertical center or the height of the room changing gradually low as radius increases, a cathodic contact ring to supply electricity being disposed the maximum diameter inside part or lower inside end of the treatment room, a porous ring near the contact ring allowing only operation liquid to pass and not allowing small articles to be electroplated to pass, an anode being disposed through an upper opening of the treatment room, the method comprising the steps of:

loading small articles to be treated in the treatment room;

while the treatment room is rotated, pouring a former treatment liquid through the opening and conducting the former treatment for a predetermined time;

stopping the supply of the former treatment liquid;

prior to the small articles being exposed to the air, supplying rinse water for a water rinse for another predetermined time;

stopping the supply of th rinse water and;

prior to the small articles being exposed to the air, supplying an electroplating liquid.

* * * * *